US006887120B2

(12) United States Patent
Shamitoff

(10) Patent No.: US 6,887,120 B2
(45) Date of Patent: May 3, 2005

(54) SNAPABLE TOY WITH INTERCHANGEABLE PORTIONS

(76) Inventor: Joel B. Shamitoff, 5465 Aspen St., Dublin, CA (US) 94568

( * ) Notice: Subject to any disclaimer, the term of this patent is extended or adjusted under 35 U.S.C. 154(b) by 0 days.

(21) Appl. No.: 09/989,696

(22) Filed: Nov. 20, 2001

(65) Prior Publication Data

US 2003/0036334 A1 Feb. 20, 2003

Related U.S. Application Data

(63) Continuation-in-part of application No. 09/929,784, filed on Aug. 14, 2001, now abandoned.

(51) Int. Cl.[7] ..... A63H 3/16

(52) U.S. Cl. ..... 446/99; 446/97; 446/376; 24/662

(58) Field of Search ..... 446/297, 376, 446/382, 384, 397, 97, 100, 99, 98, 107, 125, 371, 373, 379, 375, 167; 24/662; 434/259; 273/440, 447, 156, 157 R

(56) References Cited

U.S. PATENT DOCUMENTS 651,153 A 6/1900 Wilder
1,176,209 A * 3/1916 Dice ..... 446/376
1,322,713 A * 11/1919 Marshall ..... 446/100

(Continued)

*Primary Examiner*—Derris H. Banks
*Assistant Examiner*—Bena Miller
(74) *Attorney, Agent, or Firm*—Vierra Magen Marcus Harmon & DeNiro LLP

(57) ABSTRACT

A hand-held toy is disclosed having portions which may be detached with an audible "snap" and interchanged in a variety of combinations. Various embodiments of the present invention may comprise a plush toy, a cloth- or fabric-covered toy and a wire frame toy having a pliant endoskeleton covered by a polymer or the like to allow the toy to be bent into a variety of positions. The plush toy, the cloth-covered toy or the fabric-covered toy may also include a pliant endoskeleton allowing it to be bent into a variety of positions. Each of the above-described embodiments includes appendages or portions that may be detached with an audible snap and interchanged in a variety of combinations.

63 Claims, 16 Drawing Sheets

U.S. PATENT DOCUMENTS 1,566,801 A * 12/1925 Millard ..... 446/99
1,746,839 A * 2/1930 Main et ..... 446/100
2,506,328 A * 5/1950 Alger ..... 446/98
2,662,335 A * 12/1953 Calverley ..... 446/120
2,752,726 A 7/1956 Calverley
3,284,947 A * 11/1966 Dahl ..... 446/374
3,365,198 A * 1/1968 Hay ..... 273/157 R
3,419,993 A * 1/1969 Rodgers ..... 446/100
3,520,078 A * 7/1970 Klamer ..... 446/73
3,597,874 A * 8/1971 Osbury ..... 446/104
3,791,662 A 2/1974 Glass et al.
4,103,451 A 8/1978 Kawada et al.
4,186,515 A 2/1980 Ogawa
4,214,402 A 7/1980 Ogawa
4,259,807 A 4/1981 Silverstein
4,288,222 A 9/1981 Kling
4,399,632 A 8/1983 Iseki
4,579,537 A 4/1986 Leahy
4,671,514 A 6/1987 Wilson-Diehl
4,776,823 A 10/1988 Hanlon
4,840,242 A 6/1989 Chih et al.
4,964,832 A 10/1990 Bickoff
4,968,282 A 11/1990 Robson et al.
5,017,173 A 5/1991 Shapero et al.
5,052,971 A 10/1991 Young
5,090,935 A 2/1992 Monson
5,096,453 A 3/1992 Van Meter
5,277,643 A 1/1994 Ejima
5,295,889 A 3/1994 Ejima
5,344,355 A 9/1994 Silverstein
5,378,184 A 1/1995 Bro et al.
5,380,233 A 1/1995 Numoto
5,788,554 A * 8/1998 Goodwin ..... 446/100
5,807,155 A * 9/1998 Divvleeon ..... 446/73
5,897,417 A * 4/1999 Grey ..... 403/340
5,897,420 A 4/1999 Lawrence et al.
5,913,706 A 6/1999 Glickman et al.
5,924,906 A 7/1999 Grafton
6,086,447 A * 7/2000 Tucker ..... 446/384

* cited by examiner

FIG. 17
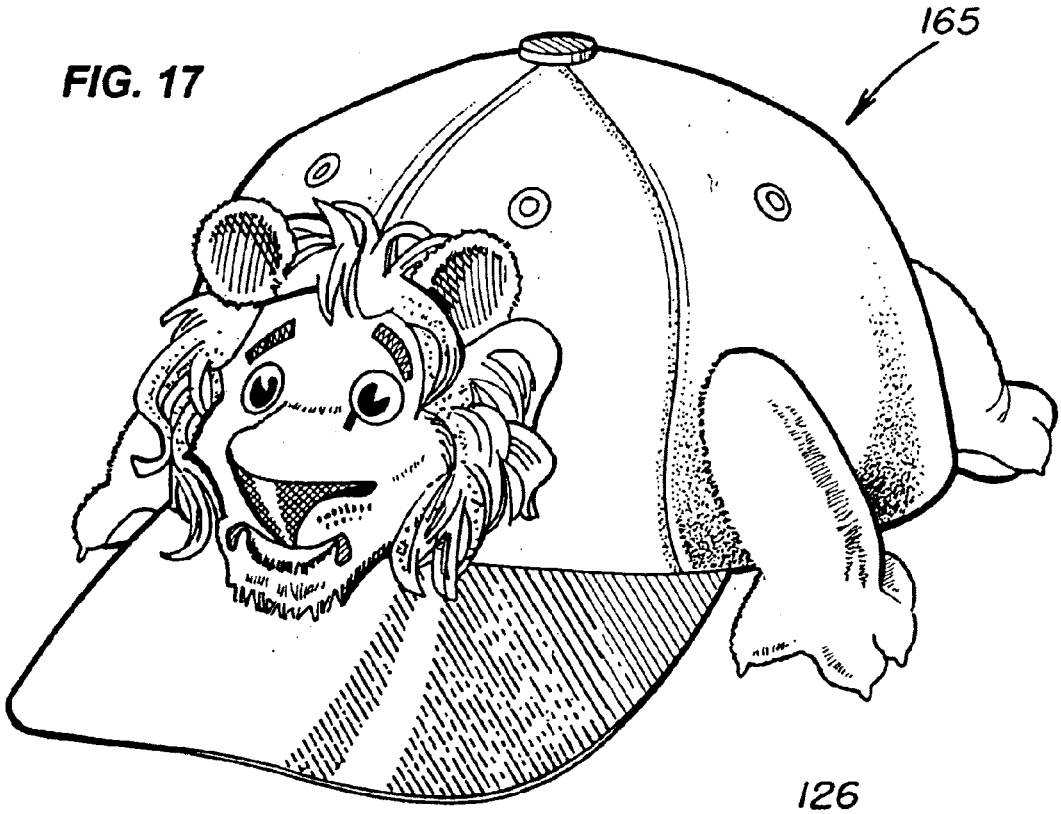
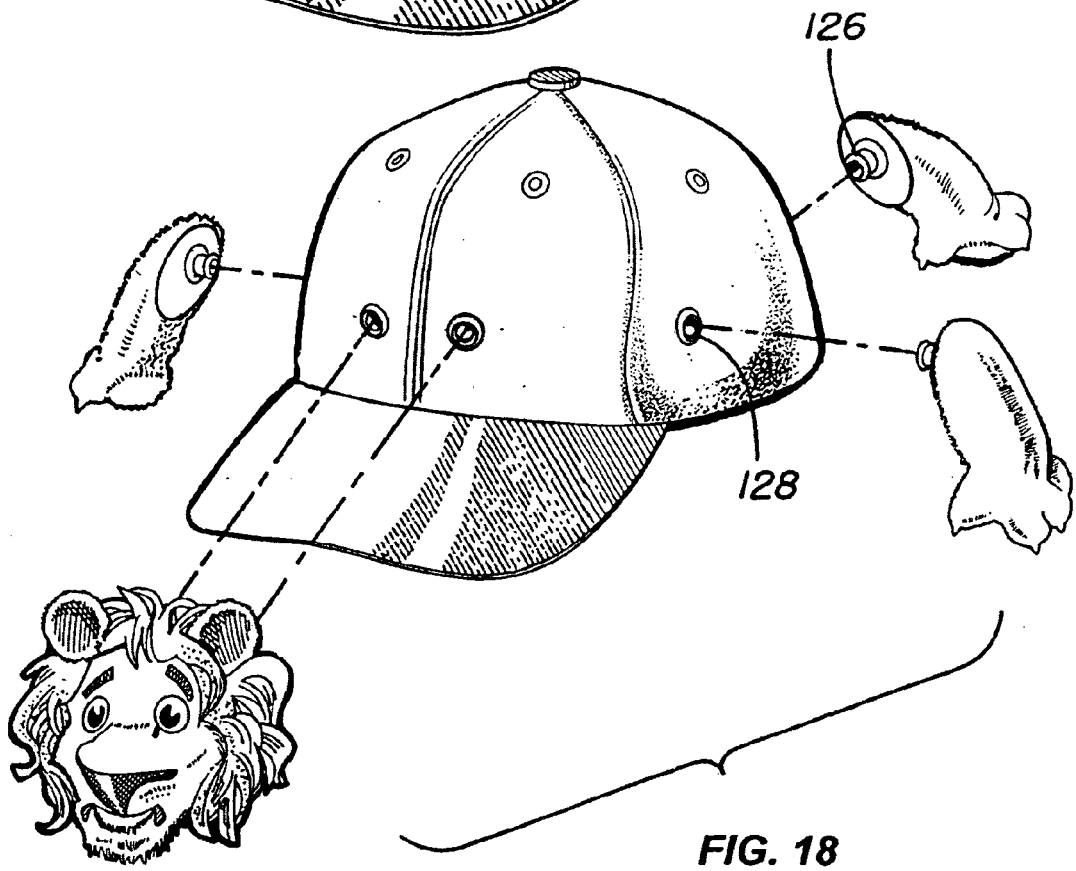
FIG. 18

SNAPABLE TOY WITH INTERCHANGEABLE PORTIONS

CROSS REFERENCE TO RELATED APPLICATION

The present application is a continuation-in-part of U.S. patent application Ser. No. 09/929,784 entitled, "Snapable Toy With Interchangeable Portions," by Joel B. Shamitoff, filed Aug. 14, 2001, now abandoned.

BACKGROUND OF THE INVENTION

1. Field of the Invention

The present invention relates to the field of hand-held toys, and in particular to hand-held toys having portions such as for example arms, legs, head, tail, ears, etc. which may be detached with an audible "snap" and interchanged in a variety of combinations.

2. Background of the Invention

It is well known in the art to provide stuffed, plush toys in the form of dolls, animals, characters and a myriad of other forms to entertain and pacify toddlers. It is also known to provide such plush toys with appendages that may be removed or otherwise adjusted. For example, U.S. Pat. No. 4,259,807 to Silverstein discloses a doll in which the length of the limbs may be changed to create the appearance that the doll is growing. In order to change the length of a limb, an upper portion of a limb is threaded through a loop of fabric sewn onto the torso. Thereafter, the upper portion of the limb is folded over and affixed onto a lower portion of the limb in one of various positions. The affixation position selected determines the length of the limb.

U.S. Pat. No. 5,052,971 to Young discloses a soft doll formed of latex rubber including arms and legs which can rotate with respect to its torso. The limbs each include a flange which permanently snaps into position within a circumferential groove in the torso. (See column 4, line 2). The flange and groove mating between the limbs and torso allows the limbs to move with respect to the torso.

U.S. Pat. No. 5,897,420 to Lawrence discloses a plush doll having detachable parts. The reference discloses a head and limbs of a cat, pig and bunny, each of which may be affixed to a single, generic body. FIG. 1 of that reference appears to disclose a cat head and arms and pig feet affixed to the generic torso. Lawrence discloses that the head and limbs may be attached by hook and loop fasteners.

U.S. Pat. No. 4,776,823 to Hanlon similarly discloses a toy such as a teddy bear in which a portion of the doll's face may be detached and changed to create different facial expressions. The reference discloses Velcro® for affixing the removable portions of the face to the doll.

In addition to the above-discussed patents, each of the following references generally discloses toys having detachable elements: U.S. Pat. No. 4,671,514 to Wilson-Diehl; U.S. Pat. No. 5,096,453 to Van Meter; U.S. Pat. No. 5,378,184 to Bro et al.; and U.S. Pat. No. 5,788,554 to Goodwin et al.

None of the above-discussed references discloses a toy including detachable and interchangeable appendages as in the present invention.

SUMMARY OF THE INVENTION

It is therefore an advantage of the present invention to provide a toy including portions which may be detached from each other with an audible "snap."

It is another advantage of the present invention to provide a toy in which detachably snapped portions may rotate with respect to each other.

It is another advantage of the present invention to provide a toy in the form of a doll, animal and/or other character including arms, legs, head and other appendages which may attach to the torso in various, imaginative combinations.

It is another advantage of the present invention to provide a toy in the form of a doll, animal and/or other character class in which the appendages from various toy classes may be interchanged to create new and imaginative toys.

It is another advantage of the present invention to provide a toy having an outer appearance in the form of various inanimate objects in which portions of the object may be detached and interchanged.

It is a still further advantage of the present invention to provide a connector allowing appendages, torsos and portions having like male or female connectors to be affixed to each other.

These and other advantages are provided by the present invention which in preferred embodiments relates to hand-held toys having portions which may be detached with an audible "snap" and interchanged in a variety of combinations. Various embodiments of the present invention may comprise a plush toy, a cloth- or fabric-covered toy, and a wire frame toy having a pliant endoskeleton covered by a polymer or the like to allow the toy to be bent into a variety of positions. The plush toy, the cloth-covered toy or the fabric-covered toy may also include a pliant endoskeleton allowing it to be bent into a variety of positions. Each of the above-described embodiments includes appendages that may be detached with an audible snap and interchanged in a variety of combinations.

Each of the above-described embodiments may have the outer appearance of a variety of toy classes. These toy classes include dolls, animals, pop culture characters and inanimate objects.

Parts from a particular toy can be detached and reattached in any configuration so that for example where the toy comprises a plush animal, a leg may be attached where the arm should be or the head attached where the tail should be. Moreover, the appendages from different toy classes may be combined to create new and imaginative toy classes.

The various detachable sections of the toy may be affixed to each other by mating male and female snap fasteners. The snap portions are provided so that an audible "snap" is produced when one section is detached from another. A similar snapping sound may also be produced upon reattaching the sections. In addition to each gratifying "snap" upon assembly and disassembly of a toy, the snaps provide the further function of allowing attached sections to rotate with respect to each other. Thus, where a toy comprises a doll, animal or character, the toy's arms and legs can swing and its head can turn. Where a toy comprises an inanimate object such as a car or plane, its wheels can spin or its propeller turn.

It is further contemplated that male/male connector pieces be provided so that the female snap portions of two or more toys may be affixed to each other. Thus, the torso of two or more toys can be affixed to each other to form even more imaginative characters. The attached torsos may be of like or dislike toys, attached side by side or one on top of each other. Moreover, appendages such as arms, legs, heads, tails, ears, etc. can be attached to each other in imaginative configurations without a torso. Female/female connector pieces may also be provided so that sections having male snap portions may be affixed together.

BRIEF DESCRIPTION OF THE DRAWINGS

The present invention will now be described with reference to the drawings, in which:

FIGS. 17 and 18 show a cap modified with snaps in accordance with the present invention to accept appendages and other toy sections;

DETAILED DESCRIPTION

The present invention will now be described with reference to FIGS. 1–22, which in preferred embodiments relates to hand-held toys having portions which may be detached with an audible "snap" and interchanged in a variety of combinations. The present invention may, however, be embodied in many different forms and should not be construed as being limited to the embodiments set forth herein; rather these embodiments are provided so that this disclosure will be thorough and complete and will fully convey the invention to those skilled in the art. Indeed, the invention is intended to cover alternatives, modifications and equivalents of these embodiments, which will be included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details. In other instances, well known methods, procedures, components, and circuits have not been described in detail as not to unnecessarily obscure aspects of the present invention.

Figure 1:
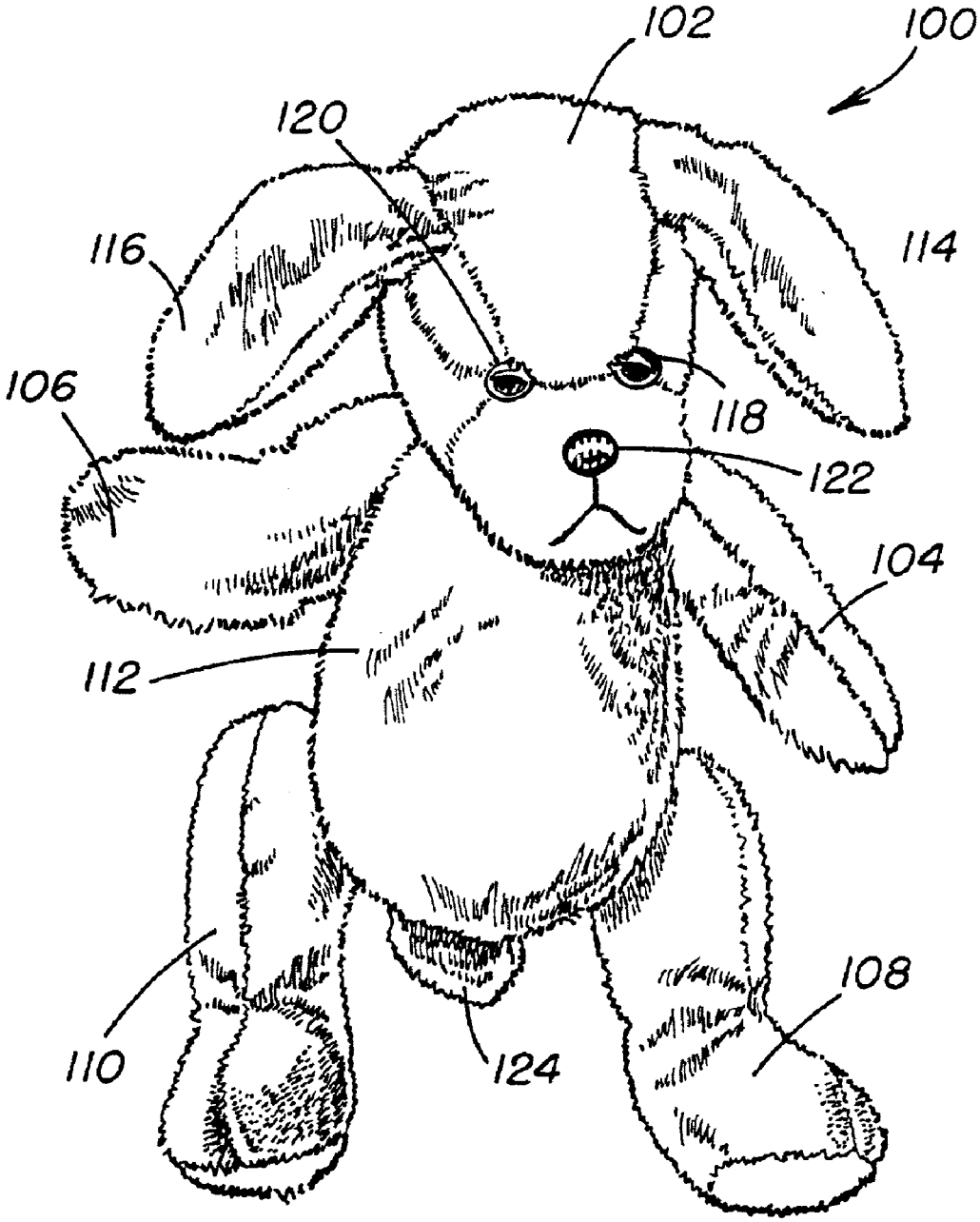
FIG. 1 is an illustration of a plush toy according to the present invention having all appendages assembled together.
Figure 2:
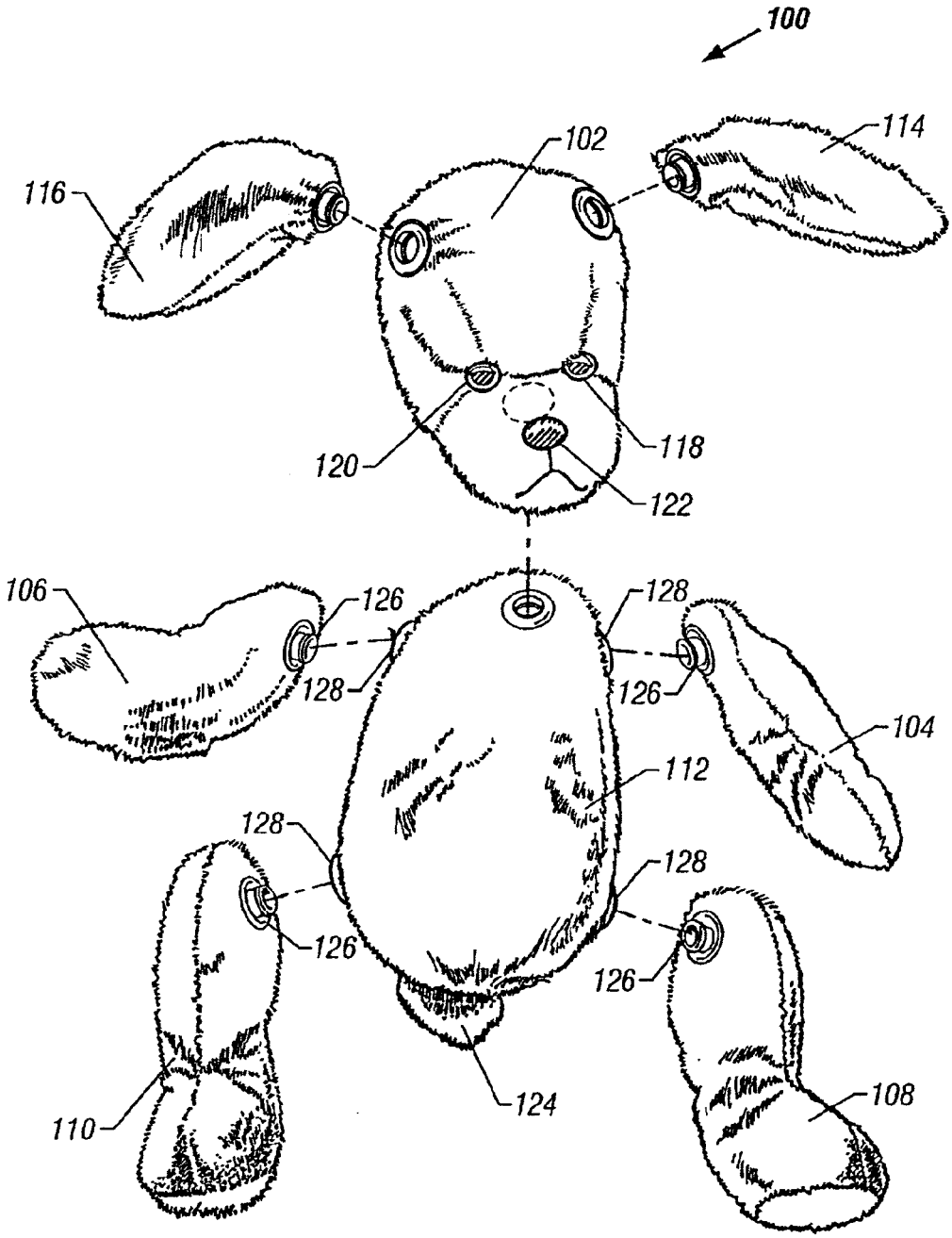
FIG. 2 is an illustration of a plush toy according to the present invention with various appendages shown detached from the torso.
Figure 3:
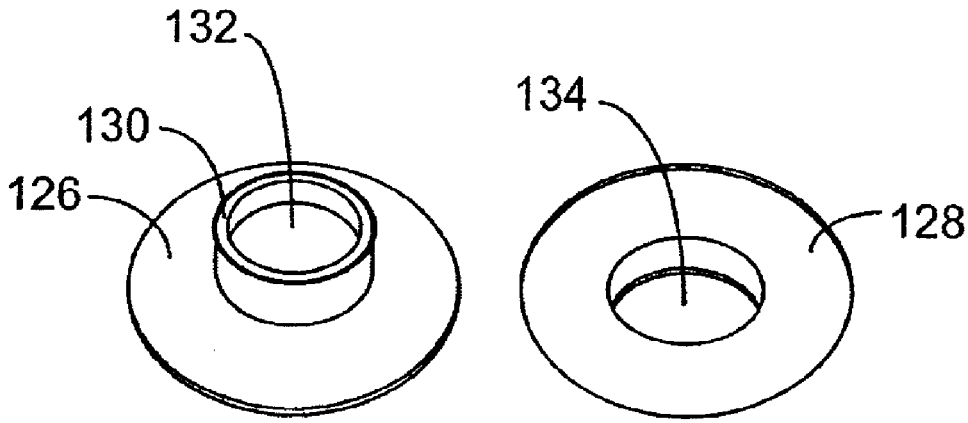
FIG. 3 is an enlarged view of the male and female portions of a snap.

Referring first to FIGS. 1–2, there is shown an embodiment of the present invention comprising a plush toy 100 having a plurality of detachable appendages, including head 102, arms 104, 106 and legs 108, 110, each attached to a torso 112. One or more of the ears 114, 116, the eyes 118, 120 and nose 122 may be detachable from the head 102 (only ears 114, 116 are shown detached in FIG. 2). The tail 124 may also be detachable from the torso 112.

Each of the various appendages and body parts can be made detachable by snaps as shown in FIG. 2. The snaps comprise a male portion 126 and a female portion 128. It is understood that the respective positions of the male and female snap portions may be reversed in alternative embodiments. The male and female portions 126, 128 may be affixed to the plush portions of the toy by known fastening schemes such as by sewing or by adhesive.

The snaps formed by portions 126 and 128 may be of conventional design, and preferably formed of durable plastic and/or metal. Those of skill in the art would appreciate that the material hardness and the relative sizes of the portions 126 and 128 are selected so that an audible "snap" is produced when an appendage is detached from the torso (or body parts are otherwise separated). A similar snapping sound may also be produced upon reattaching the appendage or body part.

As is known in the art, the male snap portion 126 includes an annular wall 130 defining a central aperture 132. The height of annular wall 130 is provided to match the depth of a recess 134 formed in the female portion 128 so that the male and female portions may snap together. Different audible snapping tones may be obtained by varying the overall size of the snap, as well as the height of wall 130 and the corresponding depth of recess 134. In an alternative embodiment, it is contemplated that the male and female portions 126, 128 emit no appreciable sound upon detaching from, and reattaching to, each other.

In addition to each gratifying "snap" upon assembly and disassembly of a toy, the snaps provide the further function of allowing the appendages to rotate with respect to the torso. Thus, a toy's arms and legs can swing and its head can turn, and a toy can be moved into a variety of positions.

Figure 4:
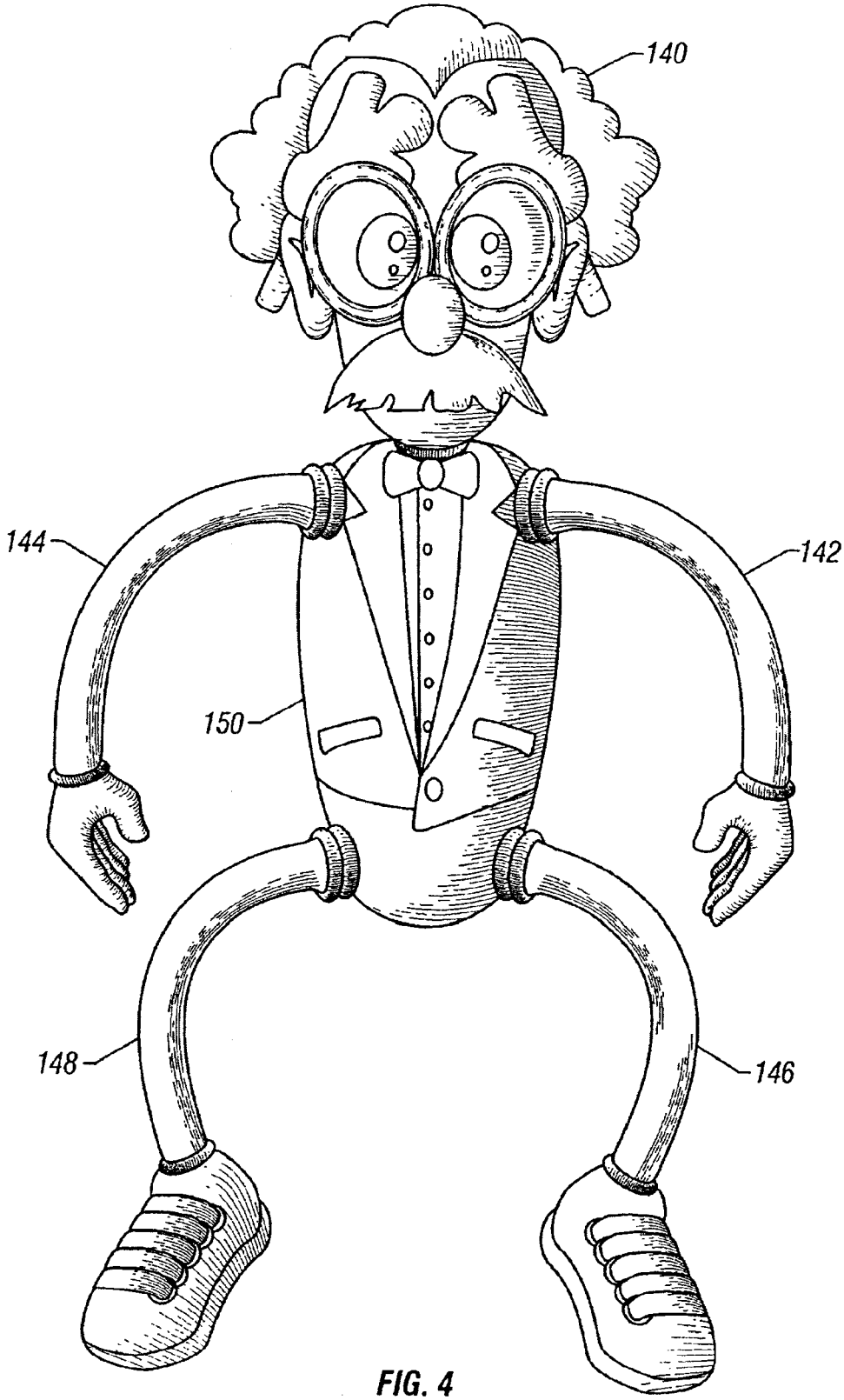
FIG. 4 is an illustration of a wire frame toy according to the present invention having all appendages assembled together.
Figure 5:
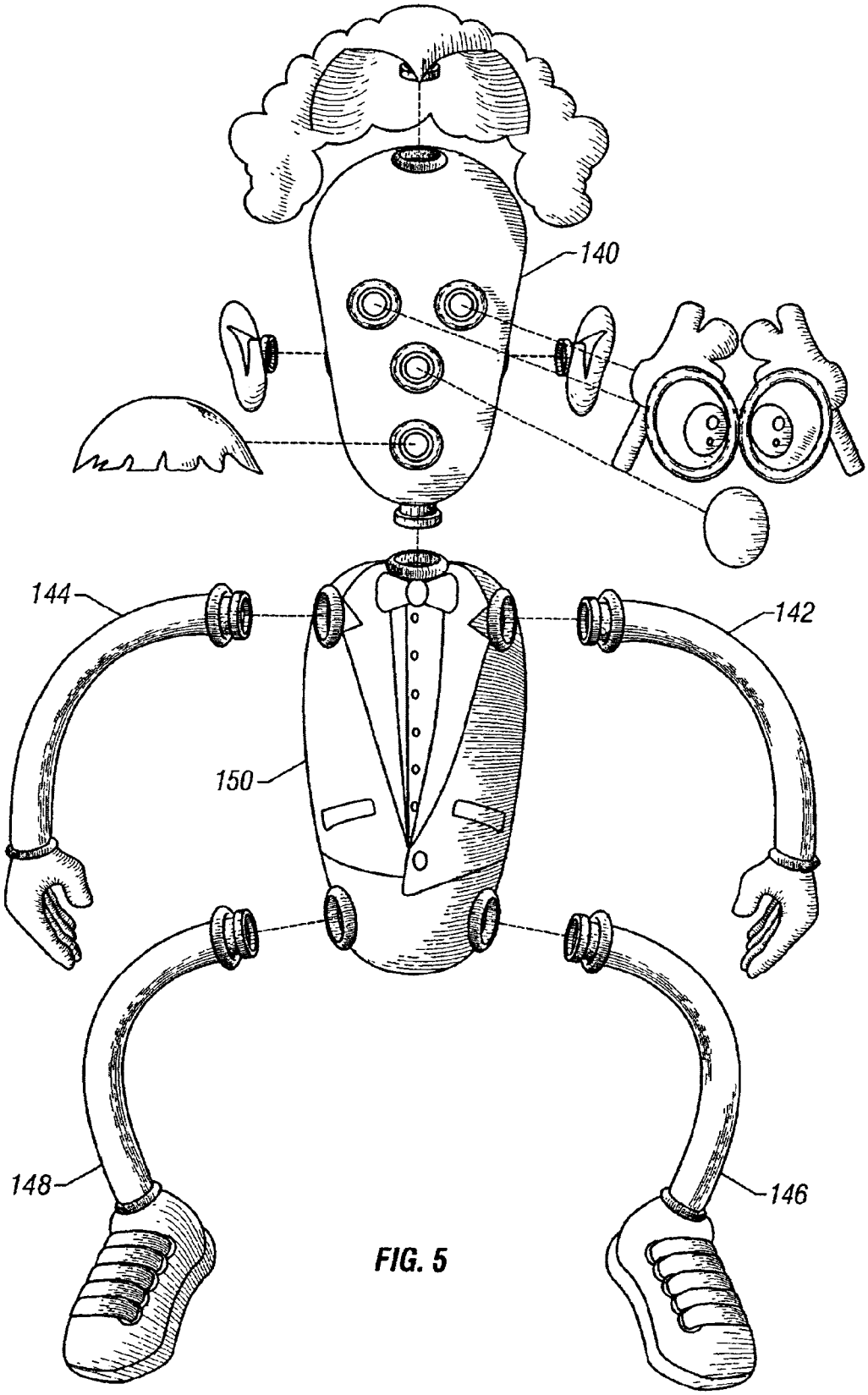
FIG. 5 is an illustration of a wire frame toy according to the present invention with various appendages shown detached from the torso.

Each of the body parts may be stuffed with a known pliant material such as for example polyurethane foam. Instead of plush on the exterior, it is understood that the toy 100 may be covered in cloth, fabric, vinyl or other material that is conventionally used for stuffed toys. Alternatively, as shown in FIGS. 4–5, the toy 100 may comprise a wire frame figure including an endoskeleton covered by a hard polymer such as a plastic or rubber. The endoskeleton is formed of a pliant and low fatiguing material such as a wire comprised one of various metals known to those of skill in the art. The endoskeleton and polymer cover allow the appendages and/or torso to be bent into and maintain various positions.

As seen in FIG. 5, the wire frame toy has a plurality of detachable appendages, including head 140, arms 142, 144 and legs 146, 148, each attached to a torso 150. In a preferred embodiment, each of the appendages and the torso include its own endoskeleton section contained therein. It is understood that less than all of the appendages and torso portions may include an endoskeleton section. Other body parts, such as the feet 152, 154 and hands 156, 158 may additionally be detachable and may or may not include their own endoskeleton sections. Moreover, as seen partially in FIG. 5, portions of the head, including for example, eyes, ears, earrings, nose, mouth, moustache, beard and hair, may be detachable to create a wide variety of characters. (While the eyes in FIG. 5 are shown detachable with the glasses as a single unit, it is understood that the eyes may detach separately).

The wire frame toy 100 may include male and female snap portions 126, 128 as described above. The female portions 128 may be affixed at various positions on torso 150 as shown in FIG. 5, either by adhesive or during the process for forming the polymer around the endoskeleton. The male portions 126 may be affixed at the proximal (i.e., the portion that attaches to the torso) and/or distal ends of the appendages as shown in FIG. 5. The male portions 126 may be affixed to the polymer either by adhesive or during the process for forming the polymer around the endoskeleton. Alternatively, the male portions 126 may be affixed to the proximal and/or distal ends of the endoskeleton sections, as by soldering or adhesive. As described above, the relative positions of the male and female portions may be reversed. As further described above, the snaps also permit the appendages and other detachable body parts to rotate at their point of attachment.

The wire frame toy 100 can be bent into and maintain various positions, and the snap portions 126, 128 allow the appendages to be detached and interchanged with various other appendages. It is further understood that any of the above embodiments comprising a plush toy, or a toy covered in cloth, fabric, vinyl or other known material, may include a wire endoskeleton in one or more of the individual detachable sections so that these toys may be bent into and maintain any of various positions.

Figure 6:
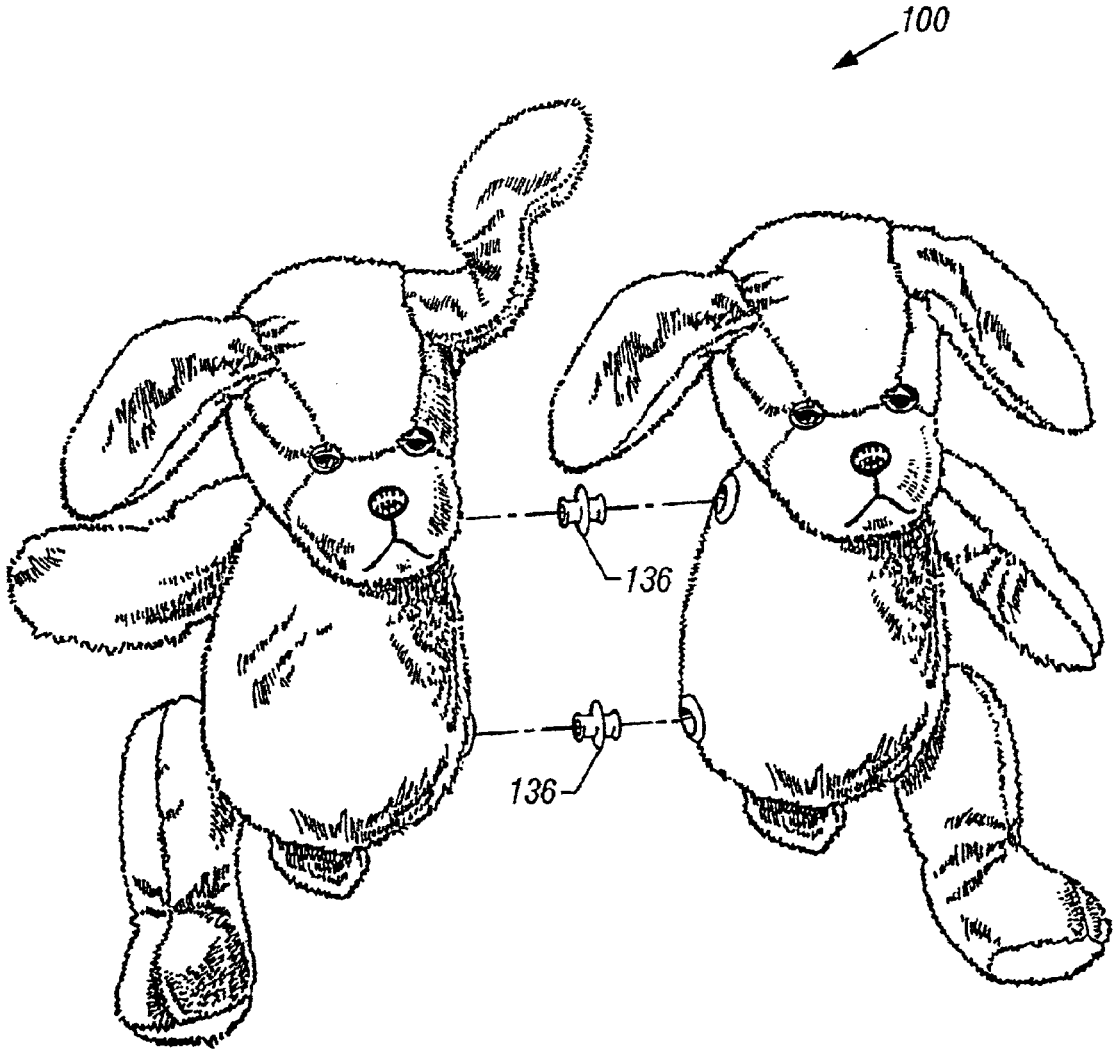
FIG. 6 is an illustration of a plush toy comprised of a pair of torsos joined by male/male connectors.
Figure 7:
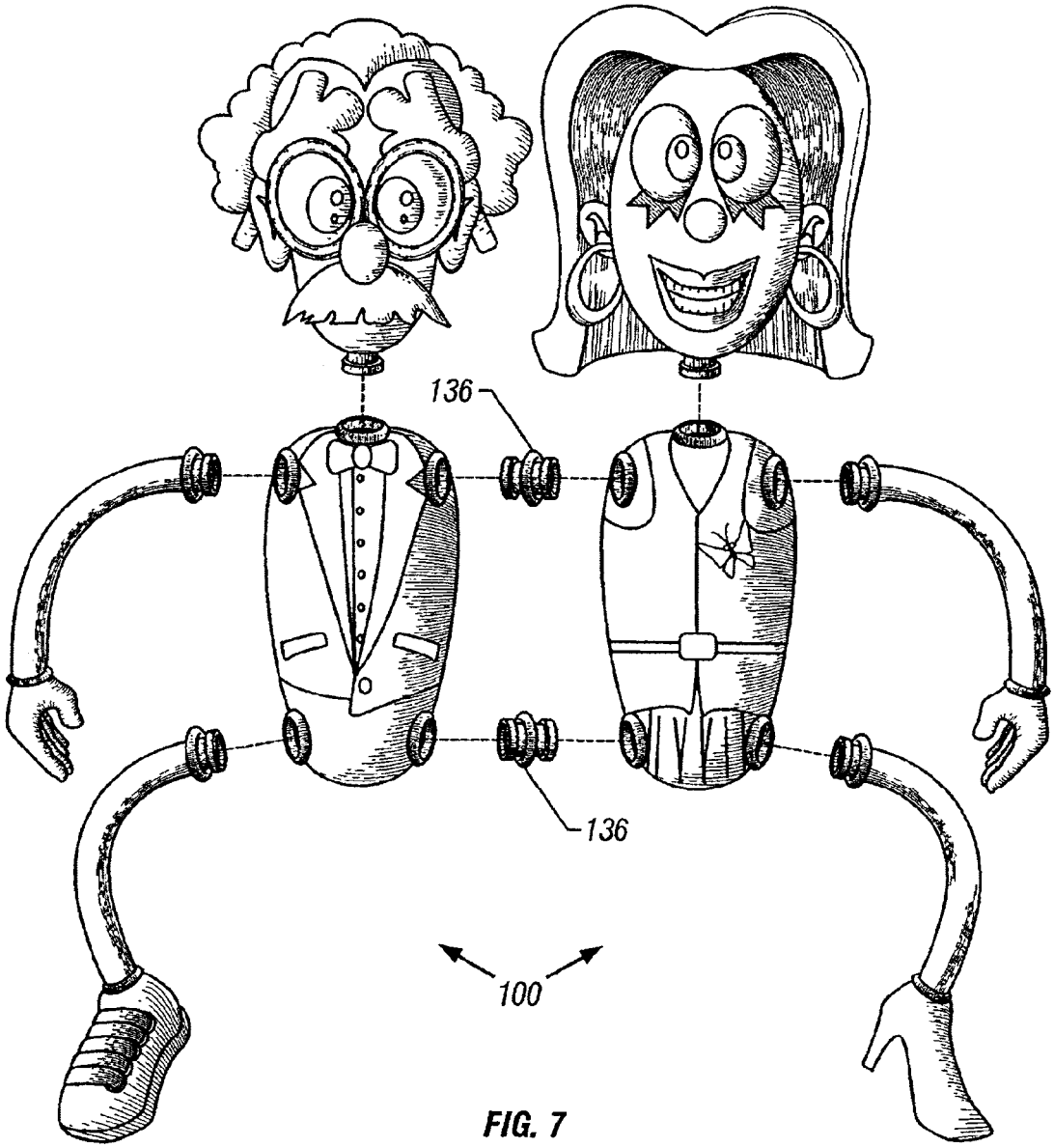
FIG. 7 is an illustration of a wire frame toy comprised of a pair of torsos joined by male/male connectors.

As shown in FIGS. 6 and 7, it is further contemplated that male/male connector pieces 136 be provided so that the torso 112 of two or more toys can be affixed to each other to form even more imaginative toys. The attached torsos may be of like or dislike toys. FIG. 6 shows two plush toy torsos being attached side-by-side. FIG. 7 shows two wire frame characters being attached side-by-side. It is also contemplated that the torsos be attached one on top of another to create a toy having for example a single head, but several arms and legs. Moreover, female/female connector pieces may also be provided to allow appendages such as arms, legs, heads, tails, ears, etc. to be attached to each other in imaginative configurations without a torso. Instead of having all torsos fit with female snap portions, it is understood that some torsos may have female snap portions while others have male snap portions. Thus, multiple torsos may be attached to each other as described above without requiring connector pieces 136.

Independent of whether the toys 100 is formed of plush, cloth, fabric, vinyl or a wire frame, the toy 100 may be any of a wide variety of toy classes, each having a different outer appearance. One toy class can be any of various dolls such as Raggedy Anne®. A second toy class can be any of various animals. In such an embodiment, in addition to the detachable appendages such as arms, legs and head shown on the puppy dog in FIGS. 1–2, the toy may have additional appendages or body parts that may be detachable, such as for example a horn for a rhinoceros, antlers for a deer, and a trunk for an elephant. A third toy class can by any of various made-up or existing pop culture characters, such as the various plush Sesame Street® characters. This class may also comprise various pop culture wire frame characters such as Captain Bendo, Pokey®, or Gumby®.

A fourth toy class can be any of various monsters, such as Pokemon®. A fifth toy class can be any of various dinosaurs. A sixth toy class can be any of various human figures, such as a mother, father, doctor, businessman, etc., or possibly a skeleton, where the various bones attach to each other by the snaps. A seventh toy class can be any of various plants and trees, where for example the branches, leaves and flower petals may be detachable. In a further toy class, the toy 100 may be in the shape of various known action figures, while including detachable appendages and/or body parts. Such action figures may include popular toys such as for example G.I. Joe®, or the Barbie® and Ken® dolls.

Figure 8:
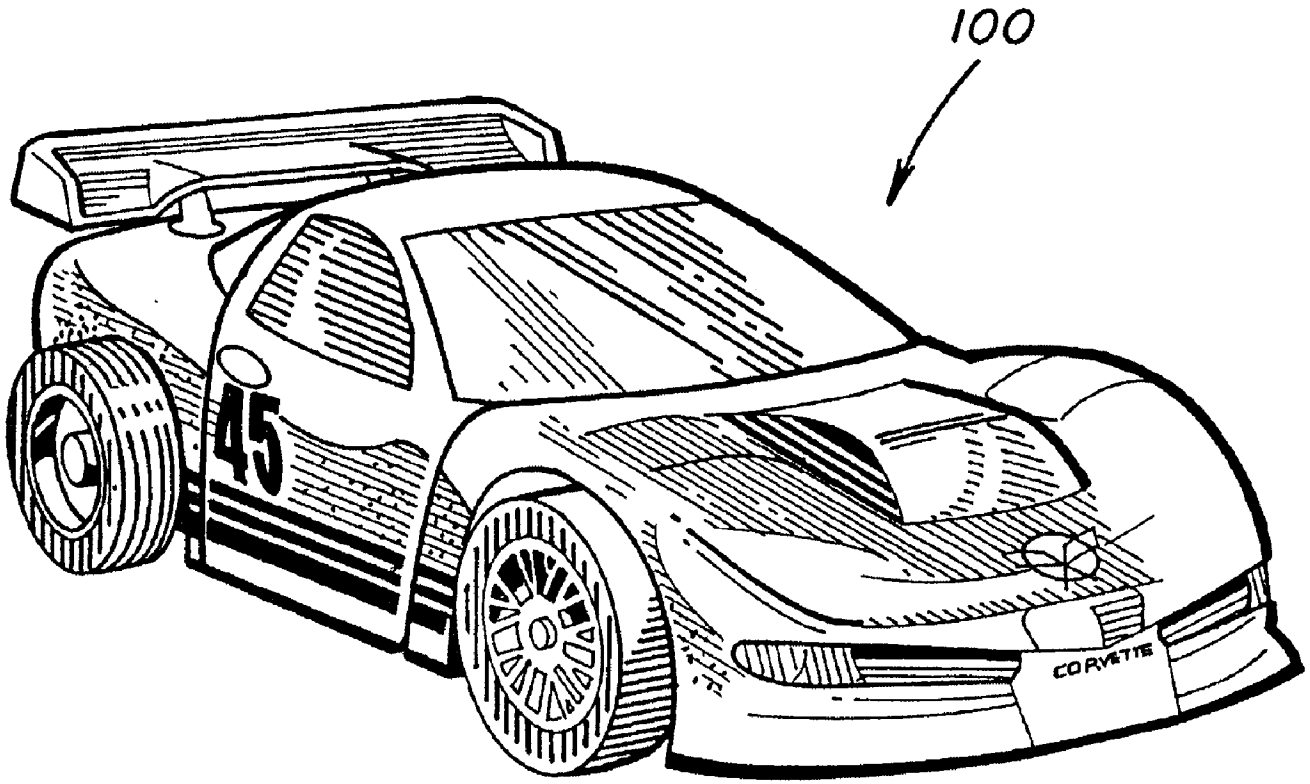
FIG. 8 is a perspective view of a first model car including Snapable sections in accordance with the present invention.
Figure 9:
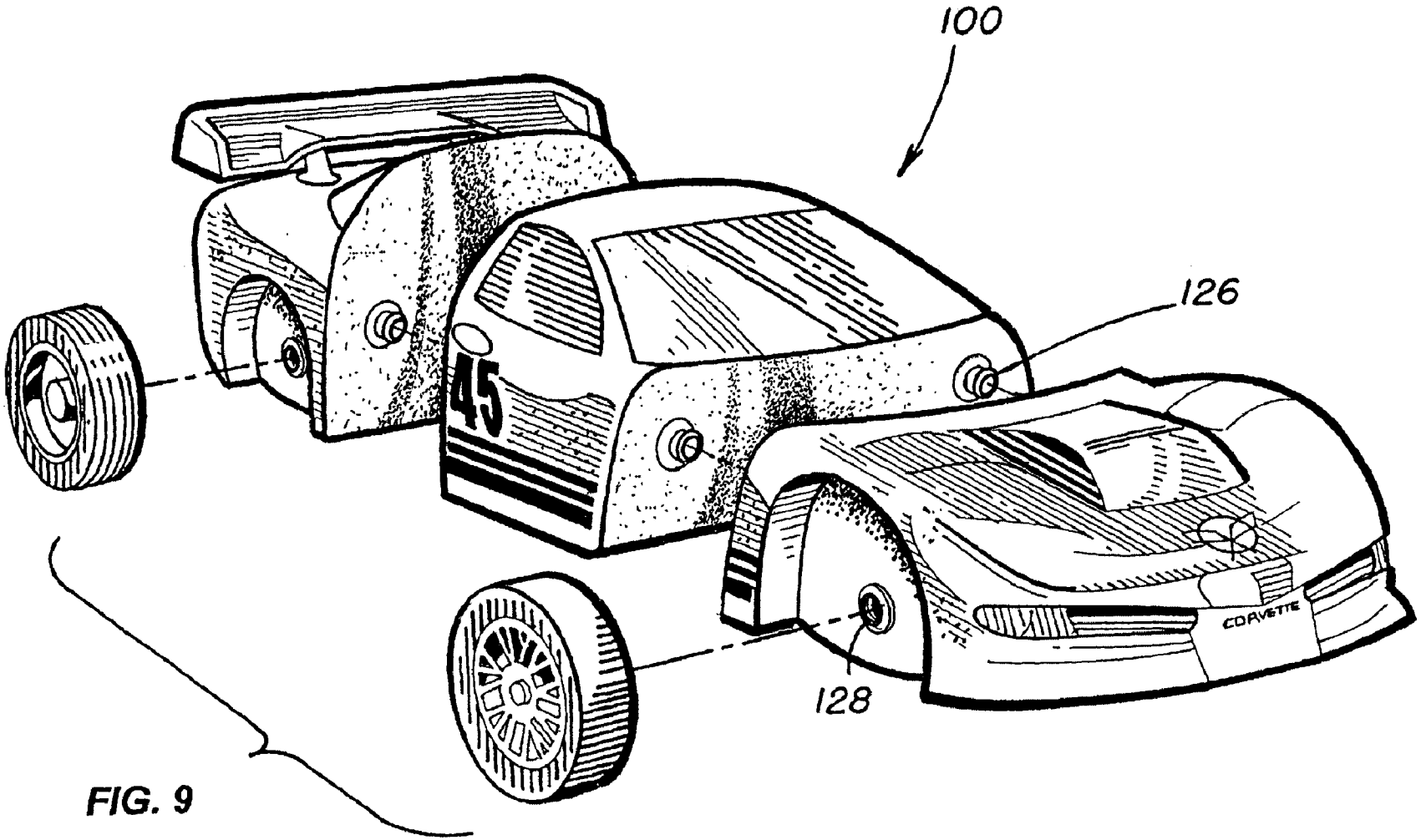
FIG. 9 is a perspective view of the first model car of FIG. 8 with the sections separated from each other.
Figure 10:
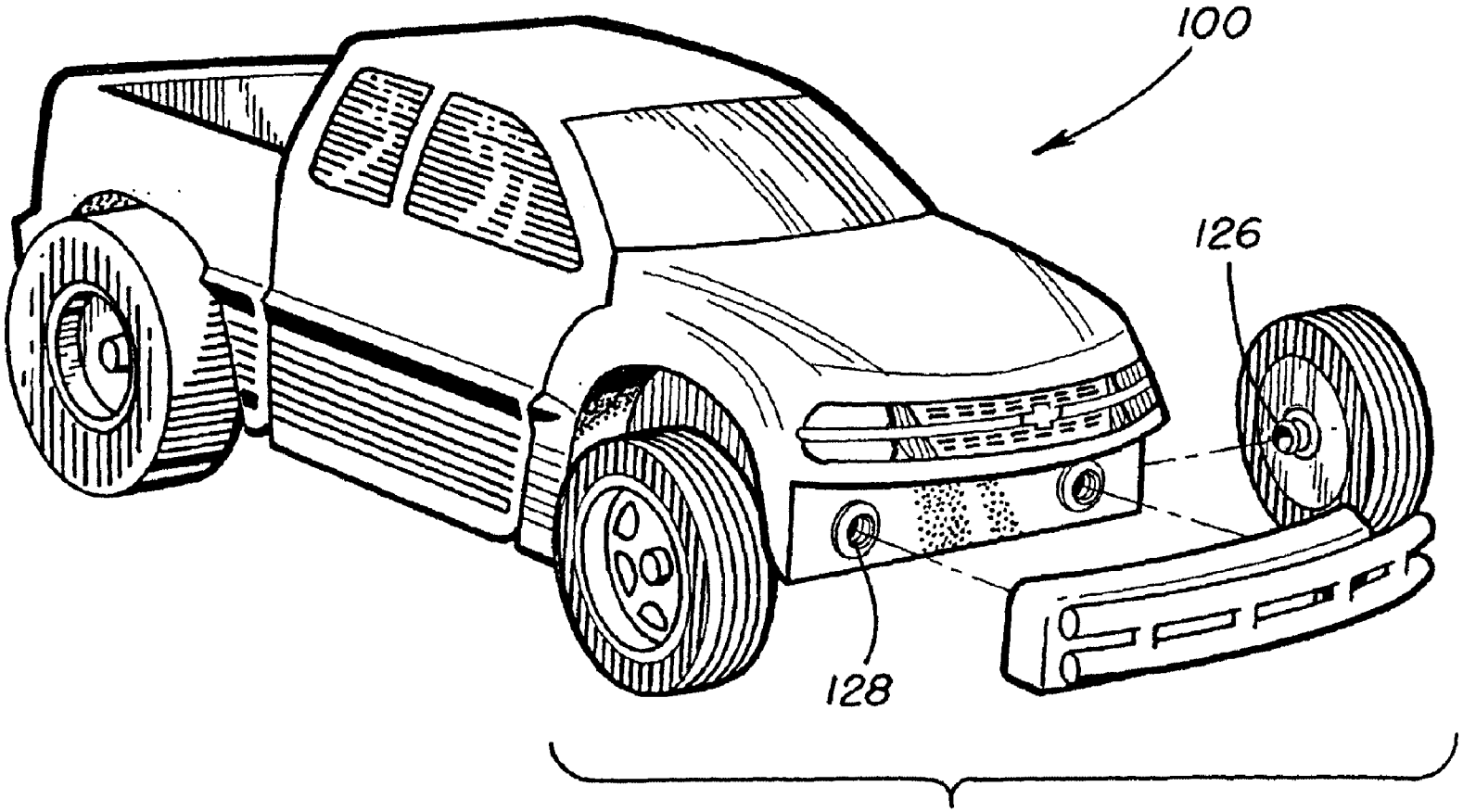
FIG. 10 is a perspective view of a second model car including Snapable sections in accordance with the present invention.
Figure 11:
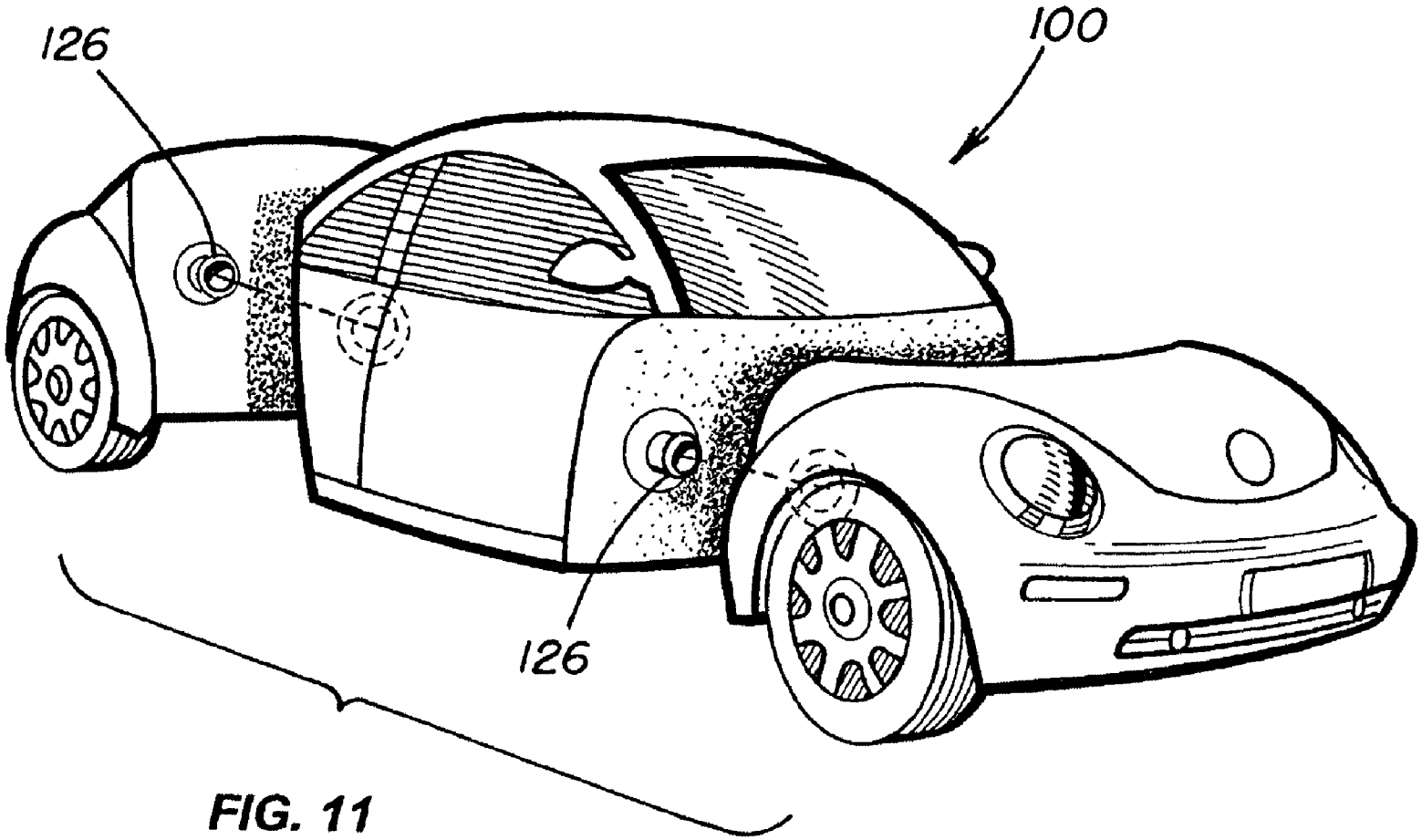
FIG. 11 is a perspective view of a third model car including Snapable sections in accordance with the present invention.
Figure 12:
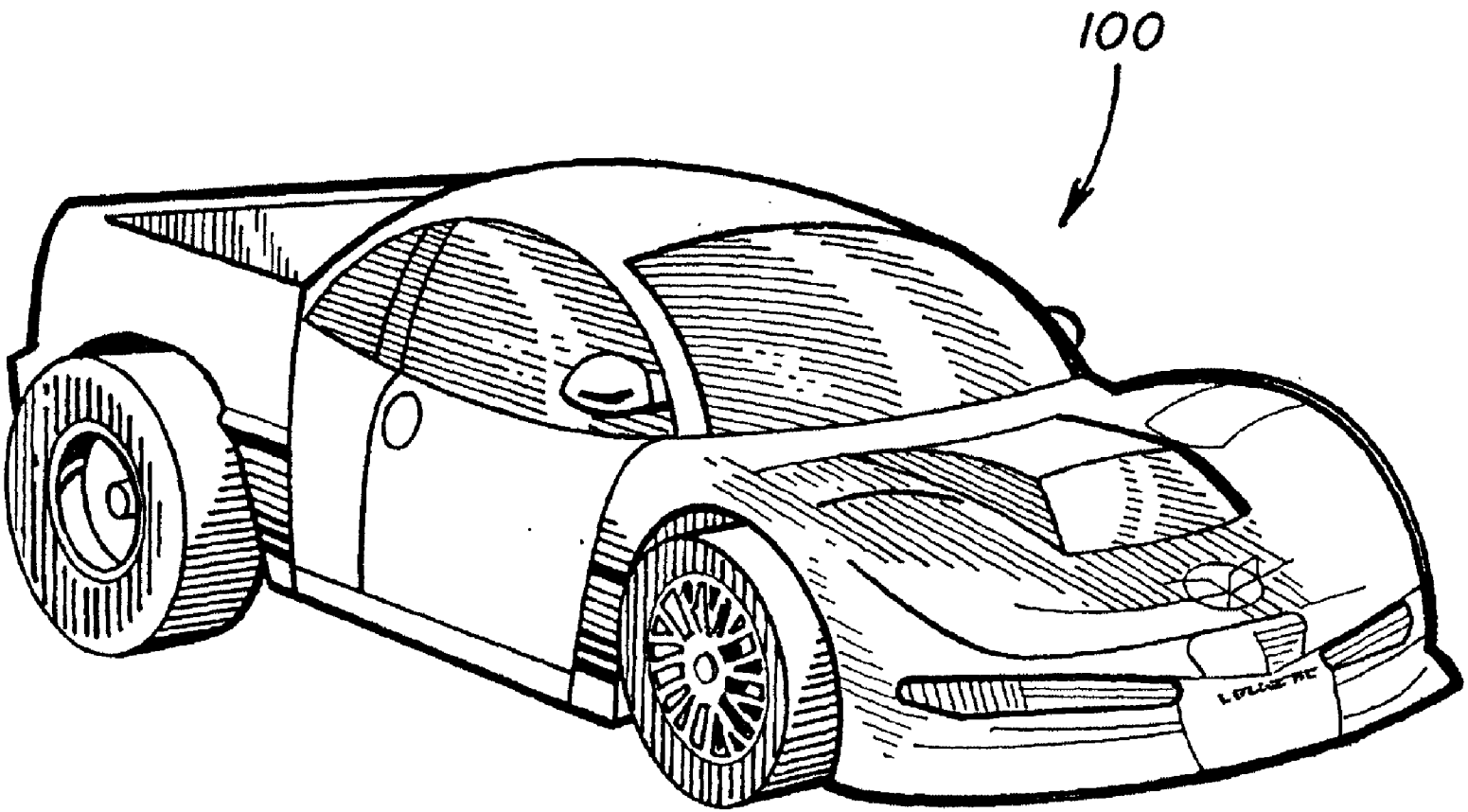
FIG. 12 is a perspective view of a model car comprised of sections from the three different cars shown in FIGS. 8–11.

In a still further toy class, toy 100 may have an outer appearance of any of various inanimate objects. For example, as shown in FIGS. 8–12, toy 100 may comprise an automobile where the front, hood section is detachable from the passenger compartment section, and the passenger compartment section is in turn detachable from the rear, trunk/flat bed section. Additionally, the wheels, doors, bumpers and/or hood ornament may also be detachable. In such a toy class, the car appearance may be that of known and recognizable car models. Portions of these models may be detached and interchanged to form new and imaginative models. For example, FIG. 8 shows a model of a Corvette® from General Motors in an assembled form, and FIG. 9 shows how the sections of the model Corvette may detach by snap portions 126, 128 from each other. FIG. 10 shows a model of a Silverado® from Chevrolet with the bumper and tire removed. The rotatable snap portions allow the tires to rotate with respect to the body of the car. FIG. 11 shows a model of a Volkswagen Beetle® with the sections separated from each other. It is understood that each of the various car sections, as well as the tires, bumpers, windows, and other appurtenances on the cars may be detachable from each other via snap portions 126, 128 in each of FIGS. 8–11. FIG. 12 shows how the sections from different cars may be affixed to each other to form new and imaginative car models. For example, FIG. 12 shows a car model comprised of a rear section from a Chevy Silverado, a mid section from a Volkswagen Beetle and a front section of a General Motors Corvette. It is understood that a wide variety of other car models are contemplated which allow new and imaginative model cars to be built using any combination of car sections and appurtenances.

Additional toys 100 having an outer appearance of an inanimate object include the sun (with for example solar flares being detachable), moon (with for example various craters being detachable), houses and buildings (with for example the doors and windows being detachable), planes (with for example the wings, windows and portions of the cabin being detachable), and trains (with for example the various cars being detachable from each other).

Figure 13:
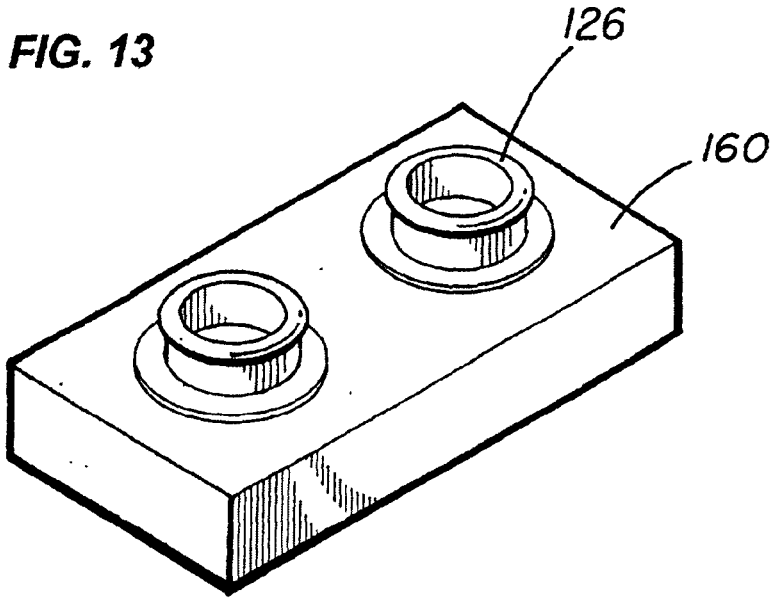
FIG. 13 is a perspective view of a block including snaps in accordance with the present invention.
Figure 14:
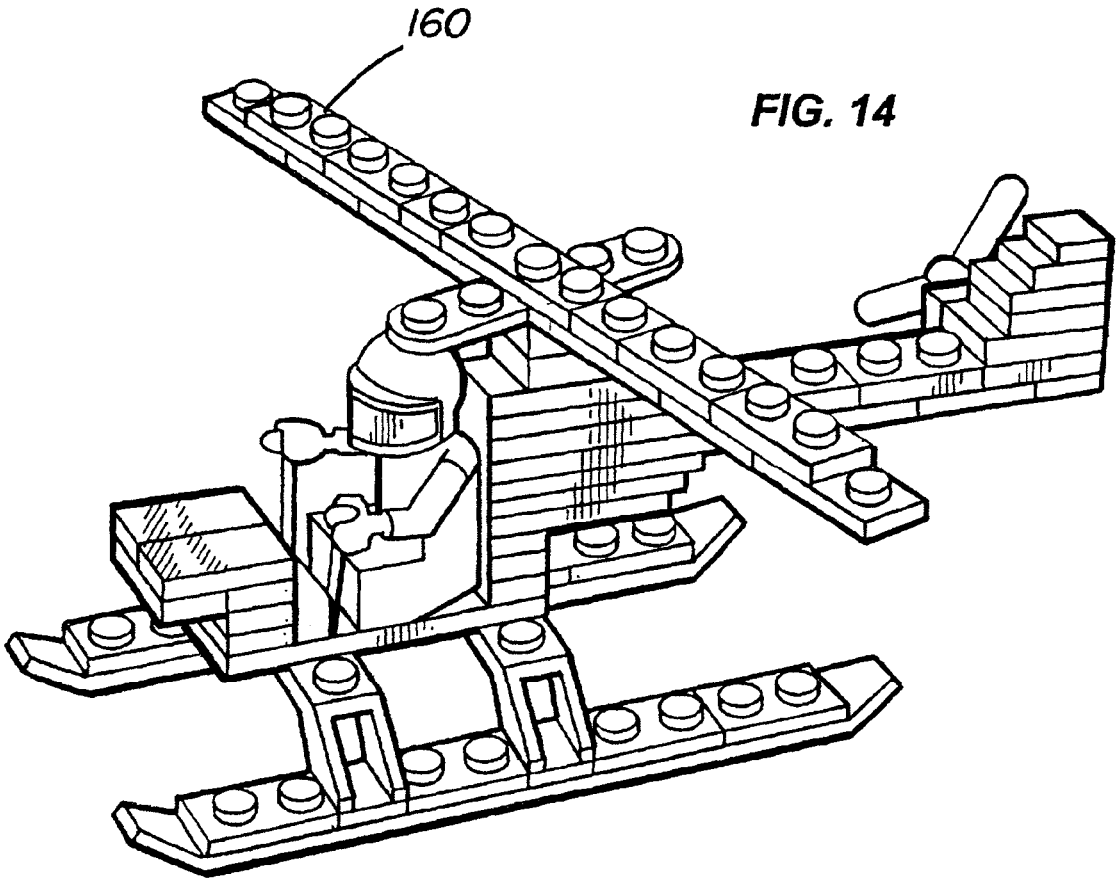
FIG. 14 is a structure built with the Snapable blocks of FIG. 13.

In a further toy class, the toy 100 may further comprise a plurality of blocks, with the male and female portions 126, 128 provided on surfaces of the blocks so that the blocks may be affixed to each other to build various structures and objects. For example, as shown in FIG. 13, a block may be provided with male portions 126 on a first surface of a block 160 and female portions 128 (not shown) on an opposed surface of the block 160. The block 160 shown in FIG. 13 has two male and female portions, but it is understood that the blocks may have one or more than two male/female portions in alternative embodiments. With such a configuration, the blocks 160 may be assembled into a wide variety of shapes and structures. For example, FIG. 14 shows the blocks 160 assembled into a helicopter. In such an embodiment, as the snap portions allow relative rotation of snapped portions, the rotor blades of the helicopter may be made to rotate with respect to the cab of the helicopter.

These blocks may be small, such as for example the size of conventional Lego® pieces. Alternatively, the blocks may be larger. For larger blocks, the snaps help prevent tumbling down of a built-up structure.

Figure 15:
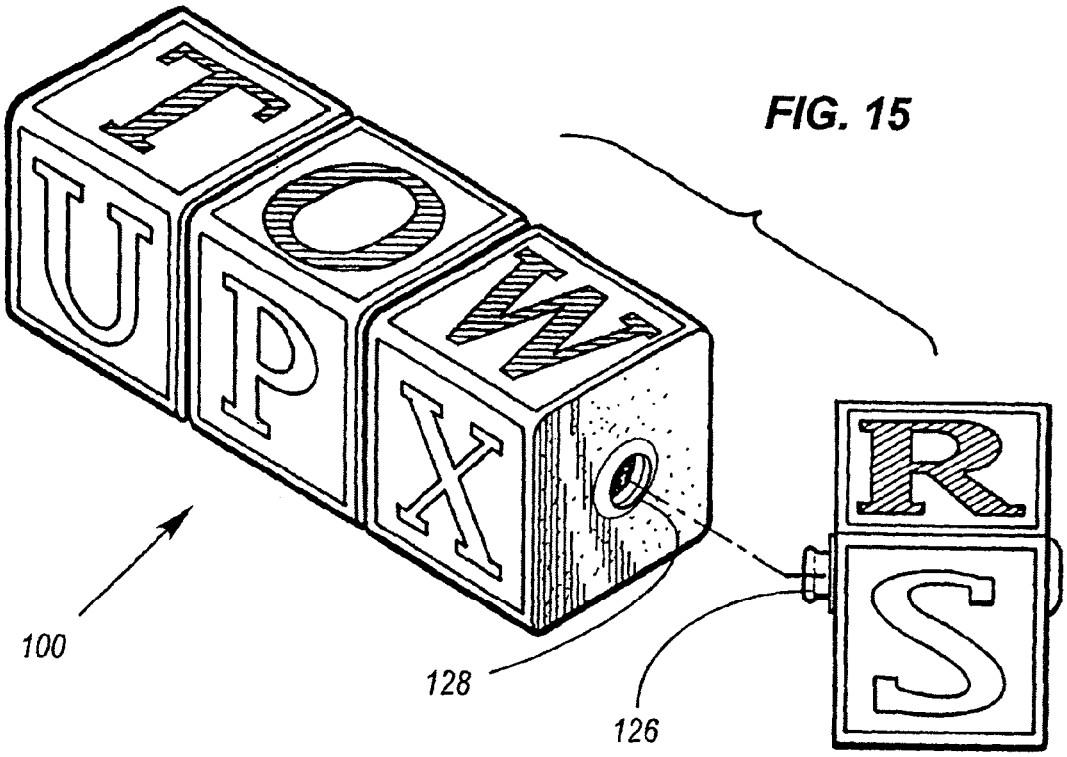
FIGS. 15 and 16 are perspective views of alphabet blocks strung together with the snaps in accordance with the present invention to spell words or other character strings.
Figure 16:
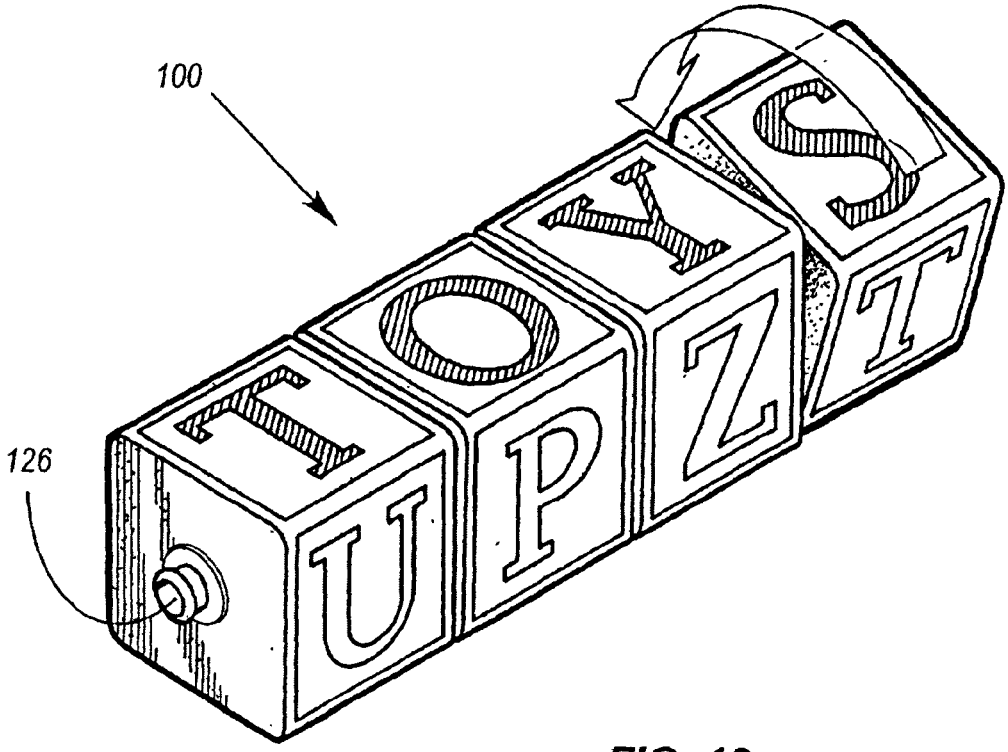

In a still further embodiment shown in FIGS. 15 and 16, blocks 162 may be provided with letters, characters or symbols on one or more of the faces. Thus for example, the blocks can have letters on four sides, with two opposed surfaces including snap portions 126, 128, so that a string of blocks can be affixed to each other to spell a word. Thereafter, the blocks in an assembled string can be rotated (about an axis through the opposed sides including the snap portions) to spell different words, depending on the letters included on the surfaces of the blocks.

It is understood that the above listing of toy classes and toys within the various classes is by no means exhaustive. Various other toy classes and toys are also contemplated within the scope of the invention.

In addition to interchanging the various appendages on a particular toy, the various appendages and detachable objects from one toy may be interchanged with the appendages and detachable objects from another toy. As the same snaps are used across the various toy classes in a preferred embodiment, original and imaginative toys may be formed from the different toys within a single toy class, or from across different classes. Thus for example, a toy 100 may comprise the torso of a man, legs formed of automobile tires, arms formed of blocks and the head formed of a flower. A great variety of other made-up and imaginative toys are possible.

Children often have favorite sports teams. In a further alternative embodiment, hats and caps adapted to fit the heads of the various toys described above can be provided with a snap portion 126 or 128. The hat or cap can include a logo, emblem or insignia, such as that of their favorite sports team. In this embodiment, the various toys described above can include a snap portion 126 or 128 on a portion of the head of the toy adapted to mate with the snap portion in the hat or cap. Thus, a child can outfit a toy 100 with the hat or cap of his or her choice.

In the previously described embodiment, a hat included snap portions so as to fit on the head of a toy 100. In a further alternative embodiment shown in FIGS. 17 and 18, a conventional hat or cap 165 (as worn by a person) can be modified in accordance with the present invention to include one or more snap portions 126 or 128 on the front, sides, back and/or brim. In this embodiment, any of various toy 100 appendages or sections can include snap portions so that the appendages/sections can be affixed to the exterior of the hat. Thus, for example, a hat may include a lion's head and appendages. A hat may also include insignia from a sports team, so that a Chicago Bears fan can affix a bear's head and appendages to his/her cap and a San Jose Sharks fan can affix a shark to his/her cap. It is understood that any of various body parts may be affixed to a hat in accordance with this embodiment. It is also contemplated that corporate logos and trademarks can be detachably snapped to a hat.

Up to this point, each of the snaps in a toy 100 has been described as being identical to each other snap. However, in an alternative embodiment, the snaps used in a toy 100 may have different sizes, such as shown for example in FIGS. 19–21. As described with respect to FIG. 3 above, by varying the height of the annular wall 130 (in male portions 126) and the depth of recess 134 (in female portions 128), the tone of the audible snap resulting from detachment or attachment may vary. Thus, for example, in the embodiment shown in FIGS. 1 and 2, the arms 104 and 106 may be detachably affixed to the torso by a first set of male/female snap portions, and the legs 108 and 110 may be detachably affixed to the torso by a second set of male/female snap portions, with the first set of snap portions having a different size than the second set of snap portions. Thus, the arms emit a different tone than the legs upon attachment to and detachment from the torso.

Figure 19:
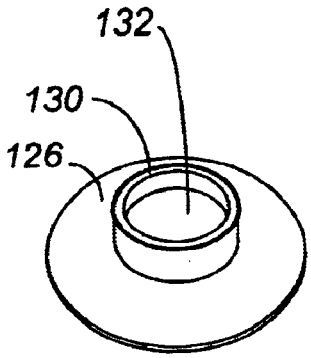
FIGS. 19–21 are perspective views of three different sized snap portions.
Figure 20:
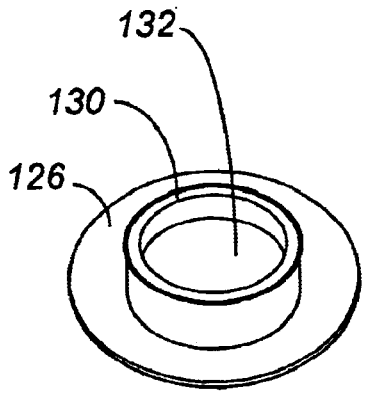
Figure 21:
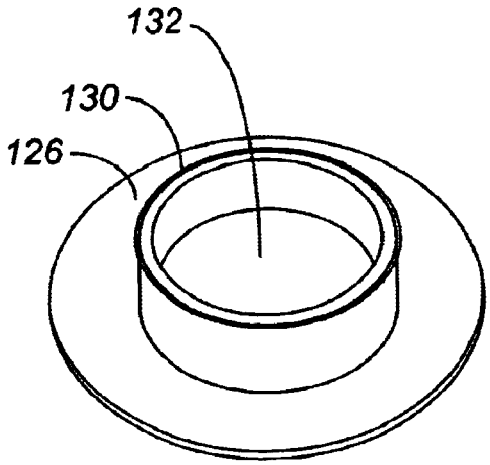

In a preferred embodiment of the present invention, each of the male snap portions 126 on respective toys and toy sections are identical to each, and each of the female snap portions 128 on respective toys and toy sections are identical to each other, thus allowing complete interchangeability of the sections within and between the various toys. However, as indicated in the previous paragraph, the snap portions may vary in size. For example, FIGS. 19–21 show three different size male snap portions 126, each including an annular wall 130 defining a central aperture 132. There may be three separate sized female portions 128 (not shown) for receiving the like-sized male portions 126. In such an embodiment, a first toy section will only attach to a second toy section if the respective toys sections include male and female snap portions of like size.

Figure 22:
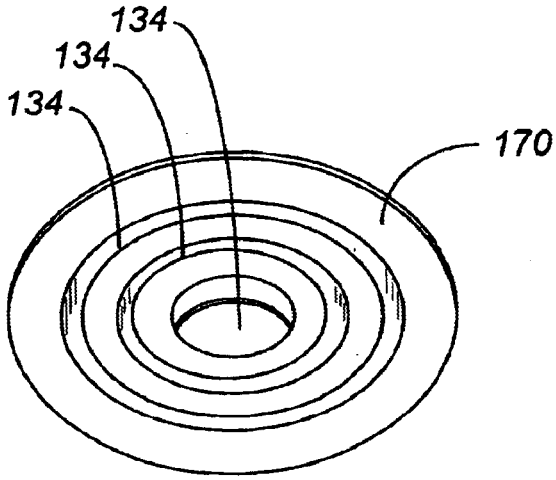
FIG. 22 is a perspective view of a universal snap portion in accordance with an alternative embodiment of the present invention.

However, even in embodiments including snap portions of different sizes, complete interchangeability of toy sections may still be desired. In accordance with a further aspect of the present invention, this may be accomplished with a universal snap portion 170 as shown in FIG. 22. The universal snap portion 170 includes a plurality of concentric annular recessed sections 134, each recessed section 134 capable of receiving one of the different sized snap portions shown in FIGS. 19–21. That is, the innermost recessed section 134 is capable of receiving the snap portion 126 shown in FIG. 19, the middle recessed section 134 is capable of receiving the snap portion 126 shown in FIG. 20, and the outermost recessed section 134 is capable of receiving the snap portion 126 shown in FIG. 21. Each of the snap portions shown in FIGS. 19–21 can attach and detach to the universal snap portion 170 with an audible snapping sound as described above.

The universal snap portion 170 shown in FIG. 22 can be used in place of each of the female snap portions 128 on the various toys 100 so as to accept male snap portions 126 of any size, thus ensuring complete interchangeability of toy sections within and between the various toys. Although the universal snap portion 170 shown in FIG. 22 includes recesses akin to the female snap portion 128, those of skill in the art would appreciate that the universal snap portion may alternatively include a plurality of concentric annular walls 130 akin to male snap portion 126. In such an embodiment, the universal snap 170 may attach to female snap portions 128 of different sizes. Moreover, although universal snap portion 170 as shown in FIG. 22 is capable of accepting three different sized male snap portions 126, it is understood that the universal snap portion 170 may be configured to accept two or greater than three different mating snap portions in alternative embodiments.

In a still further embodiment, the snaps in a toy 100 may have different shapes. This embodiment can be used to teach young children the proper position of the appendages on the torso. For example, the male and female snap portions for attaching the head in the anatomically correct position may be square shaped, the male and female portions for attaching the arms in the anatomically correct position may be round, and the male and female portions for attaching the legs in the anatomically correct position may be triangular. Thus, the respective appendages will only snap onto the torso if placed in the proper position.

Although the invention has been described in detail herein, it should be understood that the invention is not limited to the embodiments herein disclosed. Various changes, substitutions and modifications may be made thereto by those skilled in the art without departing from the spirit or scope of the invention as described and defined by the appended claims.

I claim:

1. A toy, comprising:

snapable elements, including at least two of:

one or more torsos,
one or more legs,
one or more arms,
one or more heads,
one or more animal tails,
one or more portions of an automobile,
one or more portions of an airplane,
one or more portions of a helicopter,
one or more portions of a train, and
one or more blocks including characters and/or letters; and a plurality of snap portions affixed to the at least two snapable elements, the plurality of snap portions including a first plurality of snap portions and second plurality of snap portions, said first plurality of snap portions capable of mating with and detaching from said second plurality of snap portions with an audible snapping sound, at least one of the first plurality of snap portions capable of mating with a number of different size snap portions from the second plurality of snap portions, any of said one or more torsos, said one or more legs, said one or more arms, said one or more heads, said one or more animal tails, said one or more portions of an automobile, said one or more portions of an airplane, said one or more portions of a helicopter, said one or more portions of a train, and said one or more blocks capable of being affixed to each other by said plurality of snap portion.

2. A toy as recited in claim 1, wherein said snapable elements are formed of a plush material.

3. A toy as recited in claim 1, wherein said snapable elements are formed of a pliant endoskeleton covered by a polymer.

4. A toy as recited in claim 1, wherein said plurality of snap portions further include a connector piece for connecting first and second snap portions of the first plurality of snap portions.

5. A toy as recited in claim 1, wherein said snapable elements further include at least one of:

one or more eyes,
one or more ears,
one or more earrings,
a nose,
a mouth,
a moustache,
a beard,
hair,
one or more hats,
one or more animal horns,
one or more animal antlers, and
one or more animal trunks, which include a snap portion of said plurality of snap portions for mating with a snap portion of said plurality of snap portions on a head of said one or more heads.

6. A toy, comprising:

snapable elements;

snap portions affixed to said snapable elements, said snap portions including male portions of a plurality of different sizes, and said snap portions including a female portion, each of said male portions of different sizes capable of mating with said female portion, said male portions capable of mating with and detaching from said female portions with an audible snapping sound; and said snapable elements capable of snapping together to form a toy from one of the following toy classes:

a doll,
an animal,
a monster,
a pop culture character,
a dinosaur,
a human figure,
a plant,
a tree,
an action figure,
an automobile,
a sun,
a plane,
a helicopter,
a train,
blocks having characters and/or letters, and
combinations thereof.

7. A toy as recited in claim 6, wherein said snapable elements comprise portions of a toy model of an animal, said portions capable of snapping together to form a toy model of said animal.

8. A toy as recited in claim 6, wherein said snapable elements comprise at least a first portion of a toy model of a first animal and at least a second portion of a toy model of a second animal, said first and second portions capable of snapping together to form a toy model of a combination of said first and second animals.

9. A toy as recited in claim 6, wherein said snapable elements comprise portions of a toy model of an automobile, said portions capable of snapping together to form a toy model of said automobile.

10. A toy as recited in claim 6, wherein said snapable elements comprise at least a first portion of a toy model of a first automobile and at least a second portion of a toy model of a second automobile, said first and second portions capable of snapping together to form a toy model of a combination of said first and second automobiles.

11. A toy as recited in claim 6, wherein said snapable elements comprise snapable elements from said toy class of humans and from said toy class of animals, said snapable elements capable of snapping together to form a part-human, part animal toy model.

12. A toy as recited in claim 6, wherein said snapable elements comprise snapable elements from said toy class of humans and from said toy class of monsters, said snapable elements capable of snapping together to form a part-human, part monster toy model.

13. A toy as recited in claim 6, wherein said snapable elements comprise snapable elements from said toy class of automobiles and from said toy class of humans, said snapable elements capable of snapping together to form a part-human, part automobile toy model.

14. A toy as recited in claim 6, wherein a first group of said snapable elements may be combined to form a first toy model, and a second group of said snapable elements may be combined to form a second toy model, said first and second toy models capable of being snapped together to form a third toy model.

15. A toy as recited in claim 14, wherein said first toy model is a toy model of a female and said second toy model is a toy model of a male.

16. A toy as recited in claim 6, wherein said snapable elements are formed from a plush material.

17. A toy as recited in claim 6, wherein said snapable elements are formed of a pliant endoskeleton covered by a polymer.

18. A toy, comprising:

snapable elements including:

a first plurality of snap portions having a universal snap portion, and a second plurality of snap portions;

each snap portion of the second plurality of snap portions being a first size, a second size or a third size, each of the first, second and third sizes of the second plurality of snap portions being different than each other of the sizes of the second plurality of snap portions;

said universal snap portion of the first plurality of snap portions capable of mating together with each snap portion of the second plurality of snap portions;

first plurality of snap portions and the second plurality of snap portions snapping together to form:

a doll, an animal, a monster, a pop culture character, a dinosaur, a human figure, a plant, a tree, an action figure, an automobile, a sun, a plane, a helicopter, a train, blocks having characters and/or letters, and combinations thereof.

19. A toy as recited in claim 18, wherein said first plurality of snap portions are capable of mating with and detaching from said second plurality of snap portions with an audible snapping sound.

20. A toy comprising an overall plurality of parts, each part of the overall plurality of parts including a snap portion, the toy comprising:

a first plurality of parts of the overall plurality of parts capable of snapping together by the snap portions to form a figure resembling a human, said first plurality of parts including parts resembling arms, legs, a torso and a head;

a second plurality of parts of the overall plurality of parts capable of snapping together by the snap portions to form a figure resembling an animal, said second plurality of parts including parts resembling arms, legs, a torso, a head, wings, a tail, and a trunk;

a third plurality of parts of the overall plurality of parts capable of snapping together by the snap portions to form a figure resembling a monster;

a fourth plurality of parts of the overall plurality of parts capable of snapping together by the snap portions to form a figure resembling a dinosaur;

a fifth plurality of parts of the overall plurality of parts capable of snapping together by the snap portions to form a figure resembling a plant;

a sixth plurality of parts of the overall plurality of parts capable of snapping together by the snap portions to form a figure resembling a tree;

a seventh plurality of parts of the overall plurality of parts capable of snapping together by the snap portions to form an object resembling an automobile, said seventh plurality of parts including parts resembling a front portion of the automobile, a midsection of the automobile and a rear section of the automobile;

an eighth plurality of parts of the overall plurality of parts capable of snapping together by the snap portions to form an object resembling the sun;

a ninth plurality of parts of the overall plurality of parts capable of snapping together by the snap portions to form an object resembling an airplane;

a tenth plurality of parts of the overall plurality of parts capable of snapping together by the snap portions to form an object resembling a helicopter;

an eleventh plurality of parts of the overall plurality of parts capable of snapping together by the snap portions to form an object resembling a train; and a twelfth plurality of parts of the overall plurality of parts capable of snapping together by the snap portions to form a string of attached blocks;

wherein each part of the overall plurality of parts is capable of snappably mating with each other part of the overall plurality of parts, and wherein a snap portion on a first part of the overall plurality of parts is capable of snappably mating with a plurality of snap portions on other parts of the overall plurality of parts, said plurality of snap portions on said other parts each having a different size.

21. A toy comprising an overall plurality of parts, each part of the overall plurality of parts including a snap portion, the toy comprising:

a first plurality of parts of the overall plurality of parts capable of snapping together by the snap portions to form a figure resembling a human, said first plurality of parts including parts resembling arms, legs, a torso and a head;

a second plurality of parts of the overall plurality of parts capable of snapping together by the snap portions to form a figure resembling an animal, said second plurality of parts including parts resembling arms, legs, a torso and a head;

a third plurality of parts of the overall plurality of parts capable of snapping together by the snap portions to form a figure resembling a monster;

a fourth plurality of parts of the overall plurality of parts capable of snapping together by the snap portions to form an object resembling an automobile, said fourth plurality of parts including parts resembling a front portion of the automobile, a midsection of the automobile and a rear section of the automobile;

wherein each part of the overall plurality of parts is capable of snappably mating with each other part of the overall plurality of parts, and wherein a snap portion on a first part of the overall plurality of parts is capable of snappably mating with a plurality of snap portions on other parts of the overall plurality of parts, said plurality of snap portions on said other parts each having a different size.

22. A toy as recited in claim 21, the toy further comprising:

a fifth plurality of parts of the overall plurality of parts capable of snapping together by the snap portions to form a figure resembling a dinosaur.

23. A toy as recited in claim 21, the toy further comprising:

a fifth plurality of parts of the overall plurality of parts capable of snapping together by the snap portions to form a figure resembling a plant.

24. A toy as recited in claim 21, the toy further comprising:

a fifth plurality of parts of the overall plurality of parts capable of snapping together by the snap portions to form a figure resembling a tree.

25. A toy as recited in claim 21, the toy further comprising:

a fifth plurality of parts of the overall plurality of parts capable of snapping together by the snap portions to form an object resembling the sun.

26. A toy as recited in claim 21, the toy further comprising:

a fifth plurality of parts of the overall plurality of parts capable of snapping together by the snap portions to form an object resembling an airplane.

27. A toy as recited in claim 21, the toy further comprising:

a fifth plurality of parts of the overall plurality of parts capable of snapping together by the snap portions to form an object resembling a helicopter.

28. A toy as recited in claim 21, the toy further comprising:

a fifth plurality of parts of the overall plurality of parts capable of snapping together by the snap portions to form an object resembling a train.

29. A toy as recited in claim 21, the toy further comprising:

a fifth plurality of parts of the overall plurality of parts capable of snapping together by the snap portions to form a string of attached blocks.

30. A toy comprising an overall plurality of parts, each part of the overall plurality of parts including a snap portion, the toy comprising:

a first plurality of parts of the overall plurality of parts capable of snapping together by the snap portions to form a figure resembling a human, said first plurality of parts including parts resembling arms, legs, a torso and a head;

a second plurality of parts of the overall plurality of parts capable of snapping together by the snap portions to form a figure resembling an animal, said second plurality of parts including parts resembling arms, legs, a torso, and a head;

a third plurality of parts of the overall plurality of parts capable of snapping together by the snap portions to form a figure resembling a monster;

a fourth plurality of parts of the overall plurality of parts capable of snapping together by the snap portions to form an object resembling an airplane;

wherein each part of the overall plurality of parts is capable of snappably mating with each other part of the overall plurality of parts, and wherein a snap portion on a first part of the overall plurality of parts is capable of snappably mating with a plurality of snap portions on other parts of the overall plurality of parts, said plurality of snap portions on said other parts each having a different size.

31. A toy as recited in claim 30, toy further comprising:

a fifth plurality of parts of the overall plurality of parts capable of snapping together by the snap portions to form a figure resembling a dinosaur.

32. A toy as recited in claim 30, the toy further comprising:

a fifth plurality of parts of the overall plurality of parts capable of snapping together by the snap portions to form a figure resembling a plant.

33. A toy as recited in claim 30, the toy further comprising:

a fifth plurality of parts of the overall plurality of parts capable of snapping together by the snap portions to form a figure resembling a tree.

34. A toy as recited in claim 30, the toy further comprising:

a fifth plurality of parts of the overall plurality of parts capable of snapping together by the snap portions to form an object resembling the sun.

35. A toy as recited in claim 30, the toy further comprising:

a fifth plurality of parts of the overall plurality of parts capable of snapping together by the snap portions to form an object resembling a helicopter.

36. A toy as recited in claim 30, the toy further comprising:

a fifth plurality of parts of the overall plurality of parts capable of snapping together by the snap portions to form an object resembling a train.

37. A toy as recited in claim 30, the toy further comprising:

a fifth plurality of parts of the overall plurality of parts capable of snapping together by the snap portions to form a string of attached blocks.

38. A toy comprising an overall plurality of parts, each part of the overall plurality of parts including a snap portion, the toy comprising:

a first plurality of parts of the overall plurality of parts capable of snapping together by the snap portions to form a figure resembling a human, said first plurality of parts including parts resembling arms, legs, a torso and a head;

a second plurality of parts of the overall plurality of parts capable of snapping together by the snap portions to form a figure resembling an animal, said second plurality of parts including parts resembling arms, legs, a torso, and a head;

a third plurality of parts of the overall plurality of parts capable of snapping together by the snap portions to form a figure resembling a dinosaur;

a fourth plurality of parts of the overall plurality of parts capable of snapping together by the snap portions to form an object resembling a train;

wherein each part of the overall plurality of parts is capable of snappably mating with each other part of the overall plurality of parts, and wherein a snap portion on a first part of the overall plurality of parts is capable of snappably mating with a plurality of snap portions of other parts of the overall plurality of parts, said plurality of snap portions on said other parts each having a different size.

39. A toy as recited in claim 38, the toy further comprising:

a fifth plurality of parts of the overall plurality of parts capable of snapping together by the snap portions to form a figure resembling a monster.

40. A toy as recited in claim 38, the toy further comprising:

a fifth plurality of parts of the overall plurality of parts capable of snapping together by the snap portions to form a figure resembling a plant.

41. A toy as recited in claim 38, the toy further comprising:

a fifth plurality of parts of the overall plurality of parts capable of snapping together by the snap portions to form a figure resembling a tree.

42. A toy as recited in claim 38, the toy further comprising:

a fifth plurality of parts of the overall plurality of parts capable of snapping together by the snap portions to form an object resembling the sun.

43. A toy as recited in claim 38, the toy further comprising:

a fifth plurality of parts of the overall plurality of parts capable of snapping together by the snap portions to form an object resembling a helicopter.

44. A toy as recited in claim 38, the toy further comprising:

a fifth plurality of parts of the overall plurality of parts capable of snapping together by the snap portions to form a string of attached blocks.

45. A toy, comprising:

an overall plurality of parts, each part of the overall plurality of parts including a snap portion, the overall plurality of parts including parts from one or more of:

a first plurality of parts of the overall plurality of parts capable of snapping together by the snap portions to form a figure resembling a human, said first plurality of parts including parts resembling arms, legs, a torso and a head;

a second plurality of parts of the overall plurality of parts capable of snapping together by the snap portions to form a figure resembling an animal, said second plurality of parts including parts resembling arms, legs, a torso, a head, wings, a tail, and a trunk;

a third plurality of parts of the overall plurality of parts capable of snapping together by the snap portions to form a figure resembling a monster;

a fourth plurality of parts of the overall plurality of parts capable of snapping together by the snap portions to form a figure resembling a dinosaur;

a fifth plurality of parts of the overall plurality of parts capable of snapping together by the snap portions to form an object resembling a plant;

a sixth plurality of parts of the overall plurality of parts capable of snapping together by the snap portions to form an object resembling a tree;

a seventh plurality of parts of the overall plurality of parts capable of snapping together by the snap portions to form an object resembling an automobile, said seventh plurality of parts including parts resembling a front portion of the automobile, a midsection of the automobile and a rear section of the automobile;

an eighth plurality of parts of the overall plurality of parts capable of snapping together by the snap portions to form an object resembling the sun;

a ninth plurality of parts of the overall plurality of parts capable of snapping together by the snap portions to form an object resembling an airplane;

a tenth plurality of parts of the overall plurality of parts capable of snapping together by the snap portions to form an object resembling a helicopter;

an eleventh plurality of parts of the overall plurality of parts capable of snapping together by the snap portions to form an object resembling a train; and a twelfth plurality of parts of the overall plurality of parts capable of snapping together by the snap portions to form a string of attached blocks;

wherein each part of the overall plurality of parts is capable of snappably mating with each other part of the overall plurality of parts, and wherein a snap portion on a first part of the overall plurality of parts is capable of snappably mating with a plurality of snap portions on other parts of the overall plurality of parts, said plurality of snap portions on said other parts each having a different size.

46. A toy, comprising:

a plurality of parts, each part of the plurality of parts including a snap portion, each part of the plurality of parts capable of snapping together with each other part of the plurality of parts to form at least one of a figure resembling a human, a figure resembling an animal, a figure resembling a monster, a figure resembling a dinosaur, an object resembling a plant, an object resembling a tree, an object resembling an automobile, an object resembling the sun, an object resembling an airplane, an object resembling a helicopter, an object resembling a train or a string of attached blocks;

wherein a snap portion on a first part of the plurality of parts is capable of snappably mating with a plurality of snap portions on other parts of the plurality of parts, said plurality of snap portions on said other parts each having a different size.

47. A toy, comprising:

an overall plurality of parts, each part of the overall plurality of parts including a snap portion, each part of the overall plurality of parts capable of snappably mating with each other part of the overall plurality of parts, the overall plurality of parts snapping together to form an object comprised of parts from at least two of:

a first plurality of parts of the overall plurality of parts capable of snapping together by the snap portions to form a figure resembling a human;

a second plurality of parts of the overall plurality of parts capable of snapping together by the snap portions to form a figure resembling an animal;

a third plurality of parts of the overall plurality of parts capable of snapping together by the snap portions to form a figure resembling a monster;

a fourth plurality of parts of the overall plurality of parts capable of snapping together by the snap portions to form a figure resembling a dinosaur;

a fifth plurality of parts of the overall plurality of parts capable of snapping together by the snap portions to form an object resembling a plant;

a sixth plurality of parts of the overall plurality of parts capable of snapping together by the snap portions to form an object resembling a tree;

a seventh plurality of parts of the overall plurality of parts capable of snapping together by the snap portions to form an object resembling an automobile;

an eighth plurality of parts of the overall plurality of parts capable of snapping together by the snap portions to form an object resembling the sun;

a ninth plurality of parts of the overall plurality of parts capable of snapping together by the snap portions to form an object resembling an airplane;

a tenth plurality of parts of the overall plurality of parts capable of snapping together by the snap portions to form an object resembling a helicopter;

an eleventh plurality of parts of the overall plurality of parts capable of snapping together by the snap portions to form an object resembling a train; and a twelfth plurality of parts of the overall plurality of parts capable of snapping together by the snap portions to form a string of attached blocks;

wherein a snap portion on a first part of the overall plurality of parts is capable of snappably mating with a plurality of snap portions on other parts of the overall plurality of parts, said plurality of snap portions on said other parts each having a different size.

48. A toy as recited in claim 47, said first plurality of parts including parts resembling arms, legs, a torso and a head.

49. A toy as recited in claim 47, said second plurality of parts including parts resembling arms, legs, a torso, a head, wings, a tail, and a trunk.

50. A toy as recited in claim 47, said seventh plurality of parts including parts resembling a front portion of the automobile, a midsection of the automobile and a rear section of the automobile.

51. A toy comprising:

a toy torso;

a plurality of torso snap portions affixed to the toy torso, the plurality of torso snap portions including at least one universal snap portion capable of attaching to snap portions of different sizes;

a toy arm including an arm snap portion capable of attaching to the universal snap portion on the toy torso;

a toy leg including a leg snap portion capable of attaching to the universal snap portion on the toy torso;

a toy head including a head snap portion capable of attaching to the universal snap portion on the toy torso;

at least two of the arm snap portion, the leg snap portion and the head snap portion being different sizes.

52. A toy as recited in claim 51, further comprising a toy tail including tail snap portion capable of attaching to the universal snap portion on the toy torso, at least two of the arm snap portion, the leg snap portion, the head snap portion and the tail snap portion being different sizes.

53. A toy as recited in claim 51, further comprising a portion of a toy automobile including an automobile snap portion capable of attaching to the universal snap portion on the toy torso, at least two of the arm snap portion, the leg snap portion, the head snap portion and the automobile snap portion being different sizes.

54. A toy as recited in claim 51, further comprising a portion of a toy airplane including an airplane snap portion capable of attaching to the universal snap portion on the toy torso, at least two of the arm snap portion, the leg snap portion, the head snap portion and the airplane snap portion being different sizes.

55. A toy as recited in claim 51, further comprising a portion of a toy helicopter including a helicopter snap portion capable of attaching to the universal snap portion on the toy torso, at least two of the arm snap portion, the leg snap portion, the head snap portion and the helicopter snap portion being different sizes.

56. A toy as recited in claim 51, further comprising a portion of a toy train including a train snap portion capable of attaching to the universal snap portion on the toy torso, at least two of the arm snap portion, the leg snap portion, the head snap portion and the train snap portion being different sizes.

57. A toy as recited in claim 51, further comprising a portion of a toy plant including a plant snap portion capable of attaching to the universal snap portion on the toy torso, at least two of the arm snap portion, the leg snap portion, the head snap portion and the plant snap portion being different sizes.

58. A toy as recited in claim 51, further comprising a portion of a toy tree including a tree snap portion capable of attaching to the universal snap portion on the toy torso, at least two of the arm snap portion, the leg snap portion, the head snap portion and the tree snap portion being different sizes.

59. A toy as recited in claim 51, wherein the toy torso comprises a first toy torso, the toy further comprising a second toy torso including a second torso snap portion capable of attaching to the universal snap portion on the first toy torso, at least two of the snap portion, the leg snap portion, the head snap portion and the second toy torso snap portion being different sizes.

60. A toy as recited in claim 51, the toy arm, toy leg and toy head capable of attaching to the toy torso via the plurality of torso snap portions to form a figure resembling a human.

61. A toy as recited in claim 51, the toy arm, toy leg and toy head capable of attaching to the toy torso via the plurality of torso snap portions to form a figure resembling an animal.

62. A toy as recited in claim 51, the toy arm, toy leg and toy head capable of attaching to the toy torso via the plurality of torso snap portions to form a figure resembling a monster.

63. A toy as recited in claim 51, the toy arm, toy leg and toy head capable of attaching to the toy torso via the plurality of torso snap portions to form a figure resembling a dinosaur.

* * * * *